US010287747B1

(12) United States Patent
Jones et al.

(10) Patent No.: US 10,287,747 B1
(45) Date of Patent: May 14, 2019

(54) TRENCH SCOOP BUCKET

(71) Applicants: Daniel Edward Jones, Enid, OK (US); Jason Parker Jones, Enid, OK (US)

(72) Inventors: Daniel Edward Jones, Enid, OK (US); Jason Parker Jones, Enid, OK (US)

( * ) Notice: Subject to any disclaimer, the term of this patent is extended or adjusted under 35 U.S.C. 154(b) by 0 days.

(21) Appl. No.: 15/901,129

(22) Filed: Feb. 21, 2018

(51) Int. Cl.
*E02F 5/02* (2006.01)

(52) U.S. Cl.
CPC ..... *E02F 5/025* (2013.01)

(58) Field of Classification Search
CPC . E02F 3/40; E02F 3/962; E02F 3/8152; E02F 5/025; Y10S 37/903; E01H 8/00
See application file for complete search history.

(56) References Cited

U.S. PATENT DOCUMENTS 63,952 A * 4/1867 Smawley ..... E02F 3/413 37/380
467,971 A * 2/1892 Hammer ..... A01B 1/02 294/49
721,230 A * 2/1903 Pinion ..... E02F 5/027 37/367
2,590,352 A * 3/1952 Sanner ..... E02F 5/027 37/347
2,660,323 A * 11/1953 Carlesimo ..... E02F 3/40 37/444
2,838,856 A * 6/1958 Buisse ..... E02F 3/405 37/404
2,972,425 A * 2/1961 Anderson ..... E02F 3/40 37/379
3,305,952 A * 2/1967 Dressler ..... E01H 8/00 104/279
3,885,833 A * 5/1975 Lemieux ..... E01C 23/0913 172/778
4,009,529 A * 3/1977 Johnson ..... E02F 3/815 172/719
4,043,061 A * 8/1977 Heitman ..... E02F 3/40 37/379
4,068,771 A * 1/1978 Zimmerman ..... E02F 3/40 37/403
4,314,789 A * 2/1982 Luigi ..... E02F 3/3677 37/379

(Continued)

OTHER PUBLICATIONS

"Gerikai Nursery Company", http://rekvizitai.vz.lt/imone/geriku_medelynas/, pp. 1-5, accessed on Jul. 14, 2017.

(Continued)

*Primary Examiner* — Jamie L McGowan
(74) *Attorney, Agent, or Firm* — Workman Nydegger

(57) ABSTRACT

A trench scoop bucket that can be welded to, or otherwise integrally formed with, bucket that attaches to a tractor, front loader, or any other machinery that can operate a bucket. The trench bucket is attached level with the bottom plate of the bucket and slopes down to a depth to match the dimensions of a trench. The sidewalls of the trench scoop bucket extend vertically downward to match the depth of the trench, and a ramp plate slopes from the bottom plate of the bucket into the trench. Horizontal plates are disposed on either side of the ramp plate and attached to the sidewalls to provide structural support to the ramp plate. The horizontal plates are level with the bottom plate of the trench scoop bucket and can provide alignment of the ramp plate within the trench.

19 Claims, 4 Drawing Sheets

(56) References Cited

U.S. PATENT DOCUMENTS 4,704,811 A * 11/1987 Jefferson ..... E02F 3/962 37/142.5
D299,723 S * 2/1989 Frawley ..... D15/32
4,896,444 A * 1/1990 Sieber ..... E02F 3/40 37/444
4,903,418 A * 2/1990 Loudon ..... A01G 23/043 111/101
5,212,897 A * 5/1993 Jefferson ..... E02F 3/962 37/379
5,526,591 A * 6/1996 Otwell ..... E02F 3/40 37/379
5,692,875 A * 12/1997 Boman ..... E02F 3/404 37/903
5,794,370 A * 8/1998 Haagenstad ..... E02F 3/96 37/404
5,833,008 A * 11/1998 Reed ..... A01G 23/062 171/141
5,901,479 A * 5/1999 Langdon ..... E02F 3/40 37/379
5,909,961 A * 6/1999 Pullman ..... E02F 3/40 37/444
6,067,733 A * 5/2000 Gasper ..... E02F 3/40 37/347
6,085,447 A * 7/2000 Rose ..... E02F 3/962 37/403
6,238,140 B1 * 5/2001 Boes ..... E02F 1/00 37/195
6,701,630 B2 * 3/2004 Humphrey ..... E02F 3/401 37/403
6,928,758 B1 * 8/2005 Stout ..... E02F 3/402 37/403
6,969,226 B2 * 11/2005 Raley ..... E02F 3/962 222/460

OTHER PUBLICATIONS

"New HD Stump Bucket Attachment Skid Steer Loader Utility Tree Spade Scoop Shovel", https://picclick.com/NEW-HD-STUMP-BUCKET-ATTACHMENT-Skid-Steer-Loader-322579753685.html, pp. 1-3, accessed on Jul. 14, 2017.
"New HD Tree Spade Attachment Skid Steer Loader Utility Shovel Bucket for Bobcat", https://picclick.com/NEW-HD-TREE-SPADE-ATTACHMENT-Skid-Steer-Loader-322555578543.html, pp. 1-3, accessed on Jul. 14, 2017.
"Paumco Products Quick Spade", http://www.northerntool.com/shop/tools/product_200356534_200356534, pp. 1-2, accessed on Jul. 14, 2017.
"Quick Attach Spade Combo", http://www.bucketsolutions.com/Quick-Attach-Spade.html, pp. 1-2, accessed on Jul. 14, 2017.
"Trenching Shovel", http://www.ratchetrake.com/rip_and_dig_uses.shtml. pp. 1-3, accessed on Jul. 14, 2017.
"Trenching, Stump and Rock Bucket", http://koeckeritzironandsteel.com/other-products.html, pp. 1-10, accessed on Jul. 14, 2017.

* cited by examiner

TRENCH SCOOP BUCKET

BACKGROUND

1. Technical Field

The present disclosure relates to earth moving equipment. More specifically, the present disclosure relates to trench digging buckets and features thereof that can be attached to earth moving equipment.

2. The Relevant Technology

Ditches are dug for many uses in construction industry such as laying pipe, tubes, wires, providing drainage, or tearing out sections of roads where an expansion crack has formed that is too large to be repaired, among other reasons. Presently there are many types of machines that are used for digging trenches including back hoes, skid loaders, and other trenching devices. One common device is a rotary mill. A rotary mill may be used, for example, to tear out a section of a road that where an expansion crack has formed that is too large to be repaired.

In this situation, the rotary mill may dig a trench into the road and leave road materials, earth, or other debris within the trench. Often, manual laborers with shovels or other tool then clear out earth and debris from the trench. However, this can require extensive labor and time.

Presently available trenching machines are generally slow in use and many are difficult to maneuver. Digging a trench to a desired depth, which is consistently deep and wide throughout, is difficult to accomplish with current trenching machines. That is, maintaining steady, consistent control of these machines can be difficult for an operator, which can lead to unwanted variations in the depth and width of the desired trench. Often, with some equipment such as a back hoe, multiple operations are required to remove and place dirt while digging and moving equipment.

Furthermore, a great amount of unwanted force can be applied to trenching tools that are attach to or controlled by trenching machines as earth is moved. For example, an operator may encounter an unseen rock or metal pipe while operating the trenching device, or may accidentally jam the device too deep into the earth from time to time. These forces can lead to material deformations and even failure of the trenching device and/or components thereof. Current trenching devices may also be complicated, difficult to manufacture or assemble for use, and expensive.

Therefore, it is the design of the present disclosure to provide for relatively simple, easily operable trench scoop bucket which can be readily attached to, or be integrally formed with, existing earth moving equipment that use buckets such as a front end loaders or skid loaders. It is desirable to provide a durable, easy to operate device that can be operated at any construction site and consistently form a trench with desired length, depth, and width. It is also desirable to have a simple, inexpensive, and easy to manufacture device.

BRIEF SUMMARY

The present disclosure relates to earth moving equipment. More specifically, the present disclosure relates to trench digging buckets and features thereof that can be attached to earth moving equipment.

In one embodiment, a trench scoop bucket includes a bottom plate and a ramp plate extending down and away from the bottom plate. In one embodiment, the trench scoop can also include first and second horizontal plates extending coplanar to, and away from, the bottom plate on either side of the ramp plate. First and second sidewalls can secure the ramp plate to the first and second horizontal plates on either side of the ramp plate, respectively. The ramp plate can extend down and away from the bottom plate of the bucket at an angle.

In one embodiment, a trench scoop can include first and second horizontal plates disposed on opposing sides of a ramp plate. The ramp plate can be level with the horizontal plates at the back edge of the ramp plate and extend downward so that the front edge of the ramp plate is below the first and second horizontal plates. First and second sidewalls can secure the ramp plate to the first and second horizontal plates at respective sides of the ramp plate. In one embodiments, the various plates, ramp, and sidewalls can all be welded or otherwise integrally formed into a single piece that can be removably or permanently attached to a bucket of a larger piece of earth moving equipment.

In one embodiment of the present disclosure, a method for removing earth from a trench can include providing a trench scoop and maneuvering the trench scoop so that a ramp plate extends down into a trench and first and second horizontal plates rest on surfaces directly surrounding the trench. In one embodiment, the method can also include maneuvering the trench scoop forward through the trench so that earth is drawn up the ramp plate of the trench scoop and into a bucket.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages of the disclosed embodiments will be set forth in the description which follows, and in part will be obvious from the description, or may be learned by the practice of the disclosure. These and other features will become more fully apparent from the following description and appended claims, or may be learned by the practice of the present disclosure.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

The present disclosure relates to earth moving equipment. More specifically, the present disclosure relates to trench digging buckets and features thereof that can be attached to earth moving equipment. The present disclosure may provide for a relatively simple, easily operable trench scoop bucket that can be readily attached to, or be integrally formed with, existing earth moving equipment that uses buckets such as front end loaders or skid loaders. The trench scoop bucket may be a durable, easy to operate device that can be operated at any construction site that will consistently form a trench with desired length, depth, and width. The device may also be simple, inexpensive, and easy to manufacture.

Figure 1:
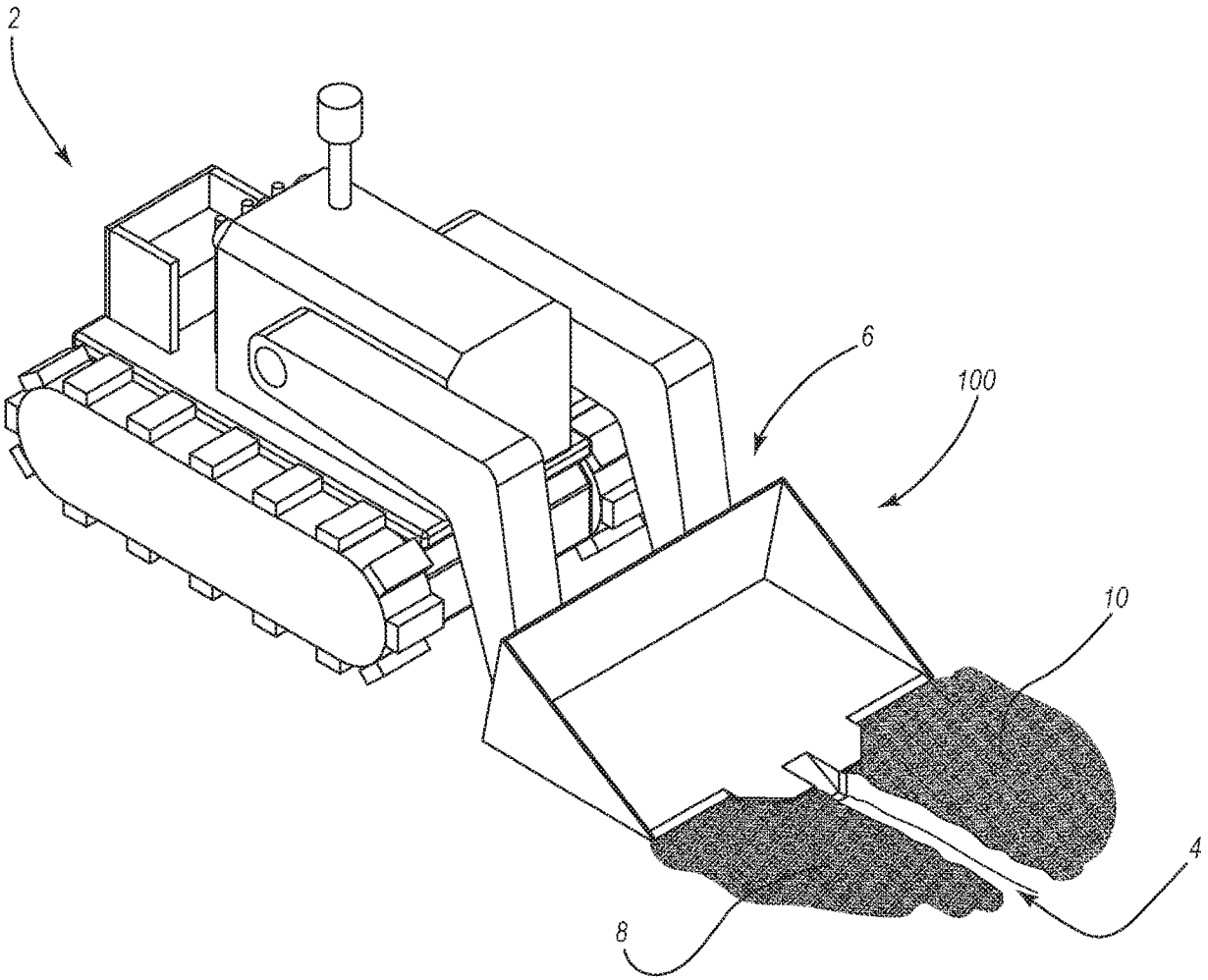
FIG. 1 illustrates an embodiment of a trench scoop bucket being maneuvered by a tractor, according to the present disclosure.

Along these lines, FIG. 1 illustrates an embodiment of a trench scoop bucket 100 being maneuvered by a machine 2 to clear earth or other debris from a trench 4. The trench scoop bucket may be configured to attach to a tractor, front loader, or any other machinery that can operate a bucket. The trench scoop bucket 100 may include connection features and/or mechanisms on a back side of the bucket 6 to allow one to attach the trench scoop bucket 100 to the machine 2 that can operate the trench scoop bucket 100. Such features and/or mechanisms are not shown in FIG. 1 or described herein, but are well known in the art.

A method for maneuvering the trench scoop bucket 100 using the machine 2 will be described in greater detail below in reference to FIG. 6. However, it is briefly noted here that FIG. 1 illustrates the trench scoop bucket 100 being maneuvered by the machine 2 so that portions of the trench scoop bucket 100 extend down into the trench 4 to remove earth or other debris therein. Portions of a road 8, 10 on either side of the trench 4 may help guide the trench scoop bucket 100 along the trench and provide a surface to ensure proper positioning of the trench scoop bucket 100 into the trench 4.

Figure 2:
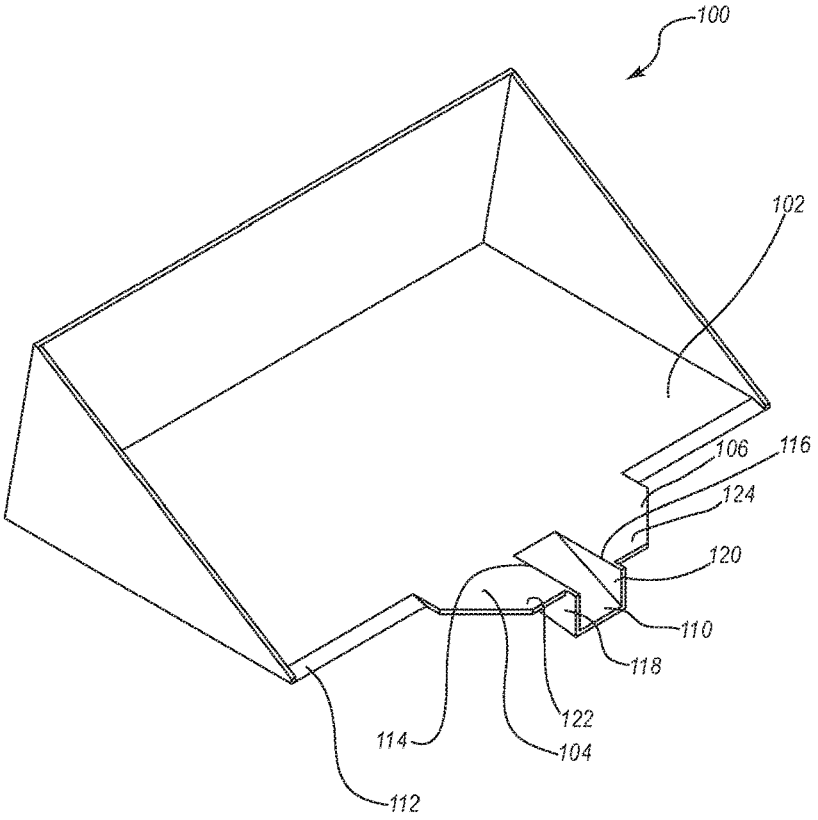
FIG. 2 illustrates a top perspective view of an embodiment of a trench scoop bucket according to the present disclosure.

FIG. 2 illustrates a top perspective view of an embodiment of a trench scoop bucket 100, similar to the embodiment of the trench scoop bucket illustrated in FIG. 1. FIG. 2 shows a trench scoop bucket 100 that includes a bottom surface 102, a first horizontal plate 104, a second horizontal plate 106, and a ramp plate 110. The bottom surface 102 of the trench scoop bucket 100 includes a front edge 112 from which much of the rest of the trench scoop bucket 100 extends.

For example, in the embodiment of the trench scoop bucket 100 illustrated in FIG. 2, the ramp plate 110 may extend away and down from the front edge 112 of the bottom surface 102. Also, both the first and second horizontal plates 104, 106 may extend away from the front edge 112 of the bottom surface 102. In one embodiment, the first and second horizontal plates 104, 106 may extend substantially coplanar with the bottom surface 102 of the trench scoop bucket 100 and be disposed on either side of the ramp plate 110. The first and second horizontal plates 104, 106 can vary in shape and size.

Figure 3:
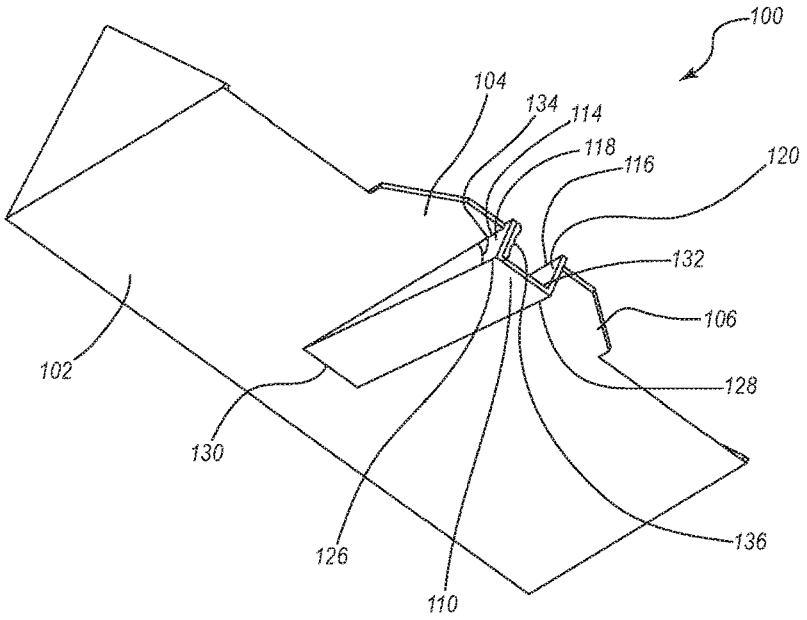
FIG. 3 illustrates a bottom perspective view thereof.

For example, in one embodiment, the horizontal plates 104, 106 may be square shaped. In another embodiment, the horizontal plates 104, 106 may be triangular or rectangular in shape. In the illustrated embodiment of FIG. 2, the horizontal plates 104, 106 are substantially rectangular with material cut out of various corners. Also, some embodiments of the trench scoop bucket 100 may include first and second slanted corner plates 122, 124 extending from each respective horizontal plate 104, 106. In any case, each horizontal plate 104, 106 may have an inside edge 114, 116. Each inside edge 114, 116 may correspond in position to outside edges of the ramp plate 110 and be connected thereto via first and second sidewalls 118, 120. FIG. 3 sheds light onto the relationship between the horizontal plates 104, 106, ramp plate 110, and sidewalls 118, 120.

In particular, FIG. 3 illustrates a bottom perspective view of a trench scoop bucket 100 similar to the trench scoop bucket illustrated in FIG. 2. Again, in one embodiment, the first and horizontal plates 104, 106 may extend from the front edge 112 of the bottom surface 102 of the trench scoop bucket 100 and be substantially flush and/or coplanar with the bottom surface 102. The ramp plate 110 may be disposed between the horizontal plates 104, 106 and extend downward, away from the front edge 112 of the bottom plate 102.

In particular, the ramp plate 110 may comprise a back edge 130 and a front edge 132. In one embodiment, the back edge 130 of the ramp plate 110 may be level with the bottom plate 102 of the trench scoop bucket 100. The ramp plate 110 may extend out and down form the bottom surface 102 so that the front edge 132 of the ramp plate 110 is below the bottom plate 102. The ramp plate 110 may extend down and away from the bottom surface 102 at an angle 134. The angle 134 can be about 45 degrees, about 30 degrees, about 20 degrees, or other angles. In one embodiment, the angle 134 may be between about 30 and 45 degrees. In yet other embodiments, the angel 134 may be greater than about 45 degrees or less than about 30 degrees. One will appreciate that the angel 134 may vary between a number of degrees between various embodiments.

The ramp plate 110 may also include a first side edge 126 and a second side edge 128. As described above, each horizontal plate 104, 106 may include an inside edge 114, 116 that corresponds in vertical position with respective to the first and second side edges 126, 128 of the ramp plate 110. In one embodiment, first and second sidewalls 118, 120 may be disposed between respective inside edges 114, 116 of horizontal plates 104, 106 and respective side edges 126, 128 of the ramp plate 110. The sidewalls 118, 120 may serve to secure the horizontal plates 104, 106 to the ramp plate 110. The sidewalls may also serve to structurally support the ramp plate 110 as the ramp plate 110 undergoes vertical forces during operation of the trench scoop bucket 100.

Similarly, the horizontal plates 104, 106, which may be secured to the ramp plate 110 via sidewalls 118, 120 as discussed above, may serve to structurally support the ramp plate 110 as the ramp plate 110 undergoes horizontal forces during operation. Also, the sidewalls 118, 120 may also undergo horizontal forces as the trench scoop bucket 100 is maneuvered through the trench 4 and the sidewalls 118, 120 make contact with the sides of the trench 4.

In one embodiment, the first and second sidewalls 118, 120 are substantially perpendicular to respective first and second horizontal plates 104, 106. Along these lines, referring briefly back to FIG. 2, the first and second slanted corner plates 122, 124 may also provide added structural support to both the sidewalls 118, 120 and thus the ramp plate 110, similar to the horizontal plates 104, 106 discussed above. In addition, the first and second slanted corners 122, 124 can provide a transition profile between the horizontal plates 104, 106 and the first and second sidewalls 118, 120, respectively, to minimize sharp angles, which may be problematic when maneuvering the trench scoop bucket 100 over rough or uneven ground, as will be described in more detail below with reference to FIG. 6. As such, various embodiments of the trench scoop bucket 100 may include slanted corner plates 122, 124 of various shapes and sizes to achieve the same functions described above.

Referring back to FIG. 3, each sidewall 118, 120 may continuously extend between the back edge 130 of the ramp plate 110 to the front edge 132 of the ramp plate 110. In this embodiment, the sidewalls 118, 120 are therefore substantially triangular in shape. Other embodiments of the trench scoop bucket 100 may include sidewalls 118, 120 that do not extend entirely between back and front edges 130, 132 of the ramp plate 110, but still provide substantial structural support to the ramp plate 110 as discussed above.

As discussed above, the ramp plate 110 may extend down from the front edge 112 of the bottom surface 102 so that the front edge 132 of the ramp plate 110 is below the bottom plate 102. This configuration results in the trench scoop bucket having a depth 136. The depth 134 may be tailored to specific trench depths for certain applications. For example, in one embodiment, the depth 134 may be about 12 inches. In one embodiment, the depth 134 may be about 10 inches. In yet other embodiments, the depth 136 may be between about 10 inches and 12 inches, or greater than about 12 inches or less than about 10 inches.

Figure 4:
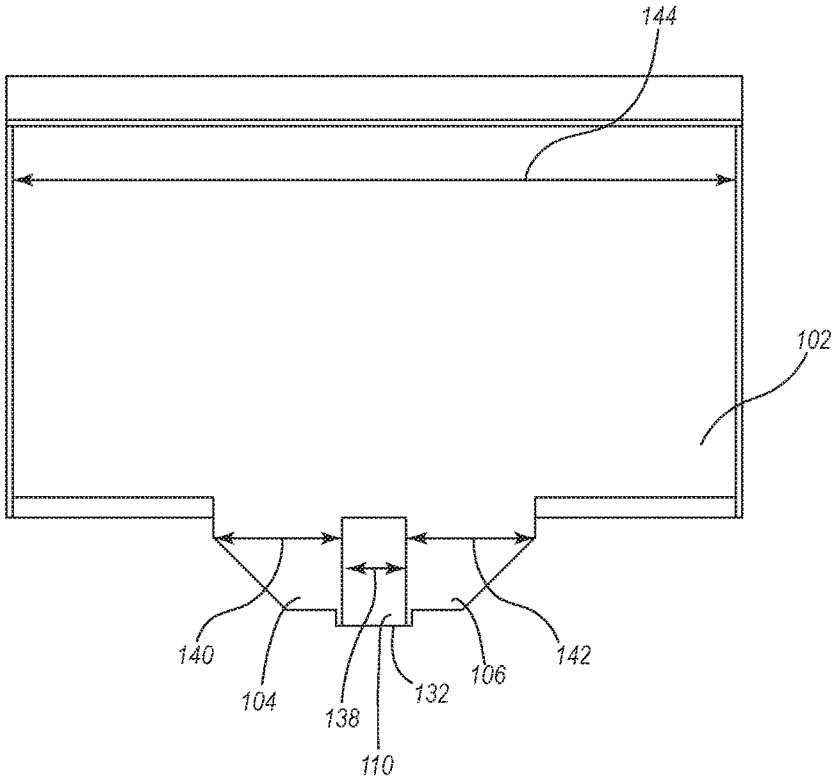
FIG. 4 illustrates a top view thereof.

Turning now to FIG. 4, a top view of an embodiment of a trench scoop bucket 100 is illustrated, similar to other trench scoop buckets described herein. In the illustrated embodiment of FIG. 4, the front edge 132 of the ramp plate 110 may extend beyond the first and second horizontal plates 104, 106. In one embodiment, the front edge 132 of the ramp plate 110 may be flush with the first and second horizontal plates 104. In yet other embodiments, the front edge 132 of the ramp plate 110 may not extend as far forward as the first and second horizontal plates 104, 106.

FIG. 4 also illustrates various widths of the first and second horizontal plates 104, 106 as well as the ramp plate 110. In one embodiment, the width 138 of the ramp plate 110 may be between about 8 inches and 14 inches. In one embodiment, the width 138 of the ramp plate 110 may be less than about 8 inches. In yet another embodiment, the width 138 of the ramp plate 110 may be greater than about 14 inches. It will be appreciated that the width 138 of the ramp plate 110 may be any suitable width appropriate for the width of the trench 4 into which the ramp plate 110 is inserted or is to create. In some embodiments, it is preferable that the width 138 of the ramp plate 110 be between about 0.5 to 1.0 inch less than the width of the trench 4. In some embodiments however, the width 138 of the ramp plate 110 may be less than 0.5 inches less than the width of the trench 4. In yet another embodiment, the width 138 of the ramp plate 110 may be more than 1 inch less than the width of the trench 4.

The depth 134 and width 138 of the ramp plate 110 may be such that a clearance space remains between the trench scoop bucket 100 and the trench 4. In this way, the trench scoop bucket 100 may remove substantially all of the earth and/or debris that may remain in the trench 4 without getting stuck or jamming in the trench 4. The depth and width of the trench 4 may depend on the dimensions of a rotary mill, or other device used to dig the trench 4.

FIG. 4 also illustrates the widths 140, 142 of both the first and second horizontal plates 104, 106. In one embodiment, the widths 140, 142 of the first and second horizontal plates 104, 106 may be about 24 inches. In one embodiment, the widths 140, 142 may be between about 15 inches and 36 inches. In yet other embodiments, the widths 140, 142 of the first and second horizontal plates 104, 106 may be greater than about 36 inches or less than about 15 inches. In the illustrated embodiment of FIG. 4, the combined widths 138, 140, 142 of the ramp plate 110 and horizontal plates 104, 106 may be less than the width 144 of the bottom plate 102. In one embodiment, the combined widths 138, 140, 142 may be equal to the width 144 of the bottom plate 102.

Figure 5:
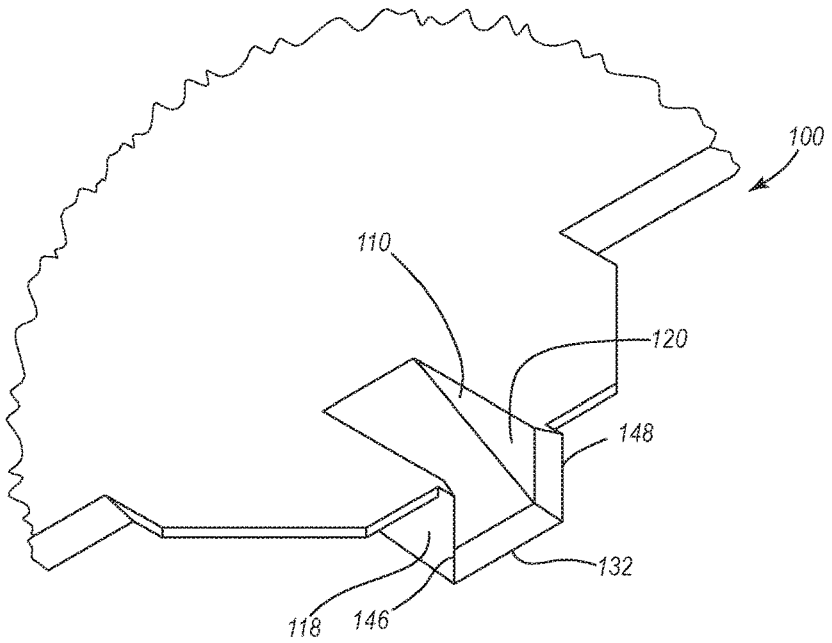
FIG. 5 illustrates a top perspective view of a trench scoop according to the present disclosure.

FIG. 5 illustrates an enlarged perspective view of a front portion of the trench scoop bucket 100. In the illustrated embodiment, the front edge 132 of the ramp plate 110, as well as front edges 146, 148 of first and second sidewalls 118, 120 may be sharpened so that the edges 132, 146, 148 effectively cut through earth and other debris in the trench 4 as the machine 2 pushes the edges 132, 146, 148 through the trench 4.

Suitable materials for the trench scoop bucket may include suitable materials known in the art for other tractor buckets and other heaving digging machinery. In one embodiments, the trench scoop bucket 100 may comprise various steels, such as cold rolled steel. Other suitable materials may include cast iron, or other metals or metal alloys that are strong enough for digging and suitable for construction applications and well known in the art.

In one embodiment of the trench scoop bucket 100, the various components, including the horizontal plates 104, 106, ramp plate 110, sidewalls 118, 120, and slanted corner plates 122, 124 may all be welded together or otherwise integrally formed together as one unitary piece. For example, the various components listed abovecould be stamped, molded, or pressed into a single unitary piece. In one embodiment, the single unitary piece may be welded or otherwise integrally formed together with the bottom plate 102 to form a single unitary trench scoop bucket 100.

In another embodiment, the various components of the trench scoop bucket 100 described herein may be removably attached together. Also, in one embodiment, the horizontal plates 104, 106, ramp plate 110, sidewalls 118, 120, and slanted corner plates 122, 124, may all be integrally formed together to form a single unitary piece, referred to here as a trench scoop. The trench scoop may be removably attached to the bottom plate of a bucket 100, so that the bucket 100 and trench scoop are two separate pieces. In such an embodiment, the trench scoop may be secured to a bucket via bolts, screws, clips, chords, or other similar mechanical securing devices known in the art.

Figure 6:
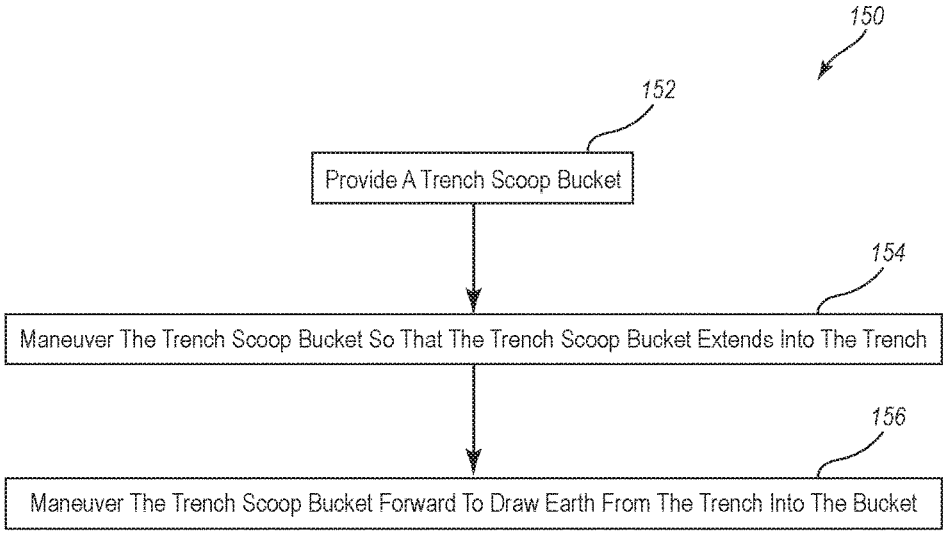
FIG. 6 illustrates a flow chart of a method for clearing earth from a trench.

FIG. 6 illustrates a method 150 for clearing earth from a trench using the various embodiments of a trench scoop bucket 100 described herein. FIG. 1 is also referred to here to help clarify the various steps of the method 150 described in FIG. 6. The method 150 may include a first step 152 of providing a trench scoop bucket such as those described herein. The trench scoop bucket 100 may be attached to a tractor 2 or other digging machine that can maneuver these and other buckets known in the art. A second step 154 may comprise maneuvering the trench scoop bucket 100 so that the trench scoop bucket 100 extends into the trench 4 or into the ground to form a trench 4. A third step 156 may comprise maneuvering the trench scoop bucket 100 forward to draw earth and other debris from inside the trench 4 into the trench scoop bucket 100.

In particular, the tractor 2 can maneuver the trench scoop bucket 100 so that the ramp plate 110 and sidewalls 118, 120 extend into the trench 4 or into the ground to form a trench 4. In some cases, a rotary mill or other trench digging device has first been used to dig the trench, and earth, rocks, or other debris may still remain within the trench 4. As the tractor 2 maneuvers the trench scoop bucket 100 forward, the ramp plate 110 is pushed through the trench. Earth and other debris remaining in the trench may be forced up the ramp plate 110 as a result of the forward motion of the trench scoop bucket 100. The earth may move up the ramp plate 110 and onto the bottom plate 102 to be captured by the bucket 100.

As the earth and/or debris from the trench 4 moves up the ramp plate 110 and onto the bottom plate 102, some of the earth may tend to spill out over the top of the sidewalls 118, 120. In the embodiments of the trench scoop bucket 100 described herein, the horizontal plates 104, 106 may serve to capture much or substantially all of the earth that spills over the sidewalls 118, 120 to direct the earth into the bucket 100. Also, the horizontal plates 104, 106 may provide surfaces to place on the road, or other surfaces on opposing sides of the trench 4, to aid in aligning the ramp plate 110 within the trench and maintaining a consistent ramp plate 110 depth in the trench 4 as the trench scoop bucket 100 moves forward.

In one embodiment, the dimensions of the trench scoop bucket 100, as described above, are such that the front edge 132 of the ramp plate and the sidewalls 118, 120 substantially conform to the shape of the trench 4. However, the dimensions may be such that a clearance space remains between the trench scoop bucket 100 and the trench 4. In this way, the trench scoop bucket 100 may remove substantially all of the earth and/or debris that may remain in the trench 4 without getting stuck or jamming in the trench 4.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A trench scoop bucket, comprising:

a bottom plate, the bottom plate having a front edge;

a ramp plate having first and second side edges, the ramp plate extending downward and away from the front edge of the bottom plate at an angle relative to the bottom plate;

a first horizontal plate substantially coplanar with the bottom plate and extending from the front edge of the bottom plate, the first horizontal plate having an inside edge;

a second horizontal plate being substantially coplanar with the bottom plate and extending from the front edge of the bottom plate, the second horizontal plate having an inside edge;

a first sidewall extending vertically up from the first side edge of the ramp plate to the inside edge of the first horizontal plate; and a second sidewall extending vertically up from the second side edge of the ramp plate to the inside edge of the second horizontal plate.

2. The bucket of claim 1, further comprising first and second slanted corner plates, wherein the first slanted corner plate extends from a front edge of the first horizontal plate to the first sidewall, and wherein the second slanted corner plate extends from a front edge of the second horizontal plate to the second sidewall.

3. The bucket of claim 1, wherein the angle of the ramp plate relative to the bottom plate is between about 30 degrees and about 45 degrees.

4. The bucket of claim 1, wherein the ramp plate extends between about 10 inches and about 12 inches below the bottom plate.

5. The bucket of claim 1, wherein the ramp plate has a width between about 8 inches and about 14 inches.

6. The bucket of claim 1, wherein the first and second horizontal plates each have a width of between about 15 inches and about 36 inches.

7. The bucket of claim 1, wherein each of the ramp plate, first sidewall, and second sidewall comprise a front edge, wherein each of the front edges of the ramp plate, first sidewall, and second sidewall is sharpened.

8. The bucket of claim 1, wherein the horizontal plates, sidewalls, ramp plate, and bottom plate are welded together or otherwise integrally formed as a single trench scoop bucket.

9. The bucket of claim 2, wherein the first and second slanted corner plates are welded or otherwise integrally formed with respective first and second horizontal plates and respective first and second sidewalls.

10. The bucket of claim 1, wherein first and second horizontal plates are substantially perpendicular to respective first and second sidewalls.

11. A trench scoop, comprising:

a ramp plate having a first side edge, a second side edge, a back edge, and a front edge;

a first horizontal plate having a back edge, a front edge, and an inside edge;

a second horizontal plate having a back edge, a front edge, and an inside edge;

a first sidewall extending vertically up from the first side edge of the ramp plate to the inside edge of the first horizontal plate;

a second sidewall extending vertically up from the second side edge of the ramp plate to the inside edge of the second horizontal plate;

a first slanted corner edge extending coplanar with the first horizontal plate from the front edge of the first horizontal plate to a top edge of the first sidewall; and a second slanted corner edge extending coplanar with the second horizontal plate from the front edge of the second horizontal plate to a top edge of the second sidewall, wherein the ramp plate extends downward from the first and second horizontal plates at an angle so that the back edge of the ramp plate is substantially level with the back edges of the first and second horizontal plates and the front edge of the ramp plate is below the first and second horizontal plates.

12. The trench scoop of claim 11, wherein the first horizontal plate, second horizontal plate, ramp plate, first sidewall, and second sidewall are welded together or otherwise integrally formed as a single unitary piece.

13. The trench scoop of claim 12, wherein the single unitary piece is configured to be removably attached to a bottom plate of a bucket.

14. The trench scoop of claim 11, wherein the angle is between about 30 degrees and about 45 degrees.

15. The trench scoop of claim 11, wherein a width of the ramp plate is between about 8 inches and about 14 inches.

16. The trench scoop of claim 11, wherein the front edge of the ramp plate is between about 10 inches to about 12 inches below the first and second horizontal plates.

17. The trench scoop of claim 11, wherein first and second horizontal plates are substantially perpendicular to respective first and second sidewalls.

18. A method of clearing earth from a trench, comprising:

providing a trench scoop bucket, comprising:

a bottom plate having a front edge;

a first horizontal plate extending from the front edge of the bottom plate;

a second horizontal plate extending from the front edge of the bottom plate;

a ramp plate disposed between the first and second horizontal plates and extending downward from the front edge of the bottom plate;

a first sidewall disposed on a first side of the ramp plate and connecting the ramp plate to the first horizontal plate; and a second sidewall disposed on a second side of the ramp plate and connecting the ramp plate to the second horizontal plate;

maneuvering the trench scoop bucket so that the ramp plate extends down into a trench and so that the first and second horizontal plates each rest on first and second surfaces surrounding the trench; and maneuvering the trench scoop bucket forward to draw earth disposed within the trench up the ramp plate and onto the bottom surface of the bucket.

19. The method of claim 18, wherein the first and second horizontal plates are configured to catch earth that may escape the ramp plate laterally over the sidewalls and further direct the escaped earth onto the bottom surface of the bucket.

* * * * *